US007592581B2

(12) United States Patent
Nakaya

(10) Patent No.: US 7,592,581 B2
(45) Date of Patent: Sep. 22, 2009

(54) CONTROL CIRCUIT FOR PHOTOMULTIPLIER TUBE

(75) Inventor: Takanori Nakaya, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 12/056,706

(22) Filed: Mar. 27, 2008

(65) Prior Publication Data

US 2008/0245950 A1 Oct. 9, 2008

(30) Foreign Application Priority Data

Apr. 4, 2007 (JP) ..... P2007-098767

(51) Int. Cl.
*H01J 40/14* (2006.01)

(52) U.S. Cl. ..... 250/214 R; 250/207

(58) Field of Classification Search ..... 250/214 R, 250/207, 214 VT, 205; 313/533, 532, 537, 313/544, 103 R, 103 CM, 105 CM
See application file for complete search history.

(56) References Cited

U.S. PATENT DOCUMENTS 3,821,546 A * 6/1974 McClenahan ..... 250/207

FOREIGN PATENT DOCUMENTS

| | | |
|---|---|---|
| JP | 3-133046 | 6/1991 |
| JP | 7-18757 | 3/1995 |
| JP | 2000-121737 | 4/2000 |

* cited by examiner

*Primary Examiner*—Que T Le
(74) *Attorney, Agent, or Firm*—Drinker Biddle & Reath LLP

(57) ABSTRACT

In this control circuit, based on a reference potential generated in a high-voltage generating circuit, a comparator outputs an over-light incidence discrimination signal to the outside of a module. It is revealed that, when an over-light incidence discrimination signal switched to high level from low level is outputted to the outside, data to be outputted from an anode terminal has no reliability while data has reliability before switching. Therefore, detection can be performed while determining reliability.

5 Claims, 3 Drawing Sheets

Io
t

DATA2
TOVER
t

DATA1
t ic
t

DATA3
t1
t2
t

CONTROL CIRCUIT FOR PHOTOMULTIPLIER TUBE

BACKGROUND OF THE INVENTION

1. Field of the Invention

The present invention relates to a control circuit for a photomultiplier tube.

2. Related Background Art

A photomultiplier tube is known as a highly sensitive photodetector that detects weak light. Photoelectrons released from a photocathode in response to incidence of weak light are amplified by dynodes, collected at an anode, and outputted to the outside. However, it has been known that, when high intensity light is made incident into the photomultiplier tube, since electron multiplication exceeding a multiplication withstanding pressure of the photomultiplier tube is performed, the photomultiplier tube is broken. Conventionally, a protection circuit against such an excessive input has been provided.

In a protection circuit described in Patent Document 1 (Japanese Patent Application Laid-Open No. H03-133046), performed is control such that, when a current outputted from an anode of a photomultiplier tube exceeds a threshold for a predetermined period of time, the photomultiplier tube is powered off, judging that over-light has been made incident.

For a light shield film breakage detecting circuit described in Patent Document 2 (Japanese Patent Application Laid-Open No. 2000-121737), a light shield film is provided at the side of a light incident surface of a photomultiplier tube, and performed is control such that, when a current outputted from an anode of the photomultiplier tube exceeds a threshold, an alarm is outputted, judging that the light shield film is damaged.

SUMMARY OF THE INVENTION

However, when an output current from the anode is monitored as described above, a case where reliability of the output current cannot be assured occurs although the anode output current has not exceeded the threshold in the course of measurement. More specifically, when a power supply to supply an operating voltage to the photomultiplier tube is deficient in supply capacity for a rise in the anode output current, a voltage to be applied between the photocathode and anode by a voltage doubler rectifier is lowered, so that the anode output current is lowered. Such a lowering phenomenon of the anode output current occurs not only when divided voltages to be supplied to the respective dynodes are generated by a resistive dividing method but also when divided voltages are generated by use of an active bleeder. The anode output current corresponds to the number of current pulses outputted from the anode per unit time when photon counting is used.

In the case of photon counting, when the incident light intensity is remarkably increased, current pulses that are continuously outputted cannot be temporally separated, and an apparent measurement output is saturated. Also, when the photocathode is grounded in advance and a coupling capacitor is inserted in an output side of the anode to extract a pulse output, if the number of output pulses per unit time increases, a phenomenon called baseline shift occurs. More specifically, when the number of output pulses per unit time increases, since the zero-level reference value of an output level of the coupling capacitor is lowered, the amplitude of pulses to be inputted to a comparator of a subsequent stage is reduced, so that the number of pulses serving as a comparator output is reduced.

Thus, when the incident light intensity is high, a value lower than the actual incident light intensity is outputted as a measurement value.

When a user observes only such a measurement value, it is impossible for him/her to discriminate whether the incident light intensity is actually low or the incident light intensity is so high that the measurement value is simply lowered. If usage is continued in the state of an excessively high incident light intensity regarding it as a normal measurement value, a device failure or deterioration in lifetime occurs.

Indeed it can also be considered to set a low anode output current as a threshold for protection in advance so as to protect the device against an incidence of over-light and perform, when an anode current exceeds this threshold, control such as turning off the power, however, in such a case, as one problem, there is an inconvenience that a measurable light intensity is reduced since a measurable anode output current is lowered, and moreover, as another problem, when the incident light intensity increases, eventually, as described above, it cannot be discriminated that the whole anode output current indicates an accurate incident light intensity, and thus usage may be continued in the state of an excessively high incident light intensity regarding it as a normal measurement value.

The present invention has been made in view of such problems, and it is an object of the present invention to provide a control circuit for a photomultiplier tube that can perform detection while determining reliability even when the intensity of incident light into a photomultiplier tube is high.

In order to solve the problems described above, a control circuit for a photomultiplier tube according to the present invention includes: a high-voltage generating circuit that generates a plurality of operating voltages to be given to a photomultiplier tube; an anode terminal that extracts an anode output of the photomultiplier tube; a discrimination unit that generates an over-light incidence discrimination signal whose value is switched when a reference potential generated by the high-voltage generating circuit falls under a threshold; and a monitor terminal that extracts the over-light incidence discrimination signal to an outside.

According to the present invention, since the discrimination unit outputs an over-light incidence discrimination signal to the outside based on the reference potential generated in the high-voltage generating circuit, it has been revealed that, when a switched over-light incidence discrimination signal is outputted to the outside, data to be outputted from the anode terminal has no reliability while data has reliability before switching. Therefore, detection can be performed while determining reliability.

Moreover, it is preferable that the discrimination unit includes: an error amplifier for a first input terminal of which the reference potential is inputted; a sensing resistor interposed between an DC input terminal and a second input terminal of the error amplifier; a comparator having a pair of input terminals to which a junction point between the second input terminal of the error amplifier and the sensing resistor and a potential that gives the threshold are connected, respectively; and a transistor which is connected at a downstream of the junction point and whose control input terminal is connected to an output terminal of the error amplifier.

When the intensity of incident light into the photomultiplier is increased and an anode current is increased, a current that is supplied to the high-voltage generating circuit via the error amplifier is also increased. It has been set so that current flows to the transistor when the current supplied to the high-voltage generating circuit reaches a certain value or more.

Since the sensing resistor is connected at an upstream of this transistor via the junction point, a current that flows through the sensing resistor is increased, and due to a decline in potential between both ends of the sensing resistor, a potential difference between the DC input terminal and the junction point is increased. That is, a potential difference of the junction point relative to the reference-side potential to be inputted to the comparator is inverted, and a comparator output is switched. That is, due to lowering in the reference potential, an over-light incidence discrimination signal to be outputted from the comparator is switched to ON.

Moreover, it is preferable that the high-voltage generating circuit has an AC generating circuit that generates an AC voltage according to an input voltage and a rectifier that generates a plurality of the operating voltages from an AC voltage outputted from the AC generating circuit, the AC generating circuit includes a primary coil connected between the output terminal of the error amplifier and a switching element and a transformer having a secondary coil connected to an input side of the rectifier, and the reference potential is a potential that is provided by resistive dividing between the secondary coil and a ground, and is fed back to the first input terminal of the error amplifier.

When the switching element becomes conductive intermittently, a current intermittently flows to the primary coil from the output terminal of the error amplifier, and at the secondary coil, generated is an AC voltage induced by a magnetic flux generated in the primary coil, and by rectifying this voltage by the rectifier, a DC voltage to be given to the photomultiplier tube can be generated. A potential of the secondary coil is indirectly represented by the reference potential provided by resistive dividing between the coil and the ground. In this structure, by detecting the potential of the transformer side by the error amplifier and adjusting a supply voltage to the primary coil, stabilization of an applied voltage to the photomultiplier tube can be realized.

Moreover, it is preferable that the primary coil is formed by connecting first and second coils having an identical polarity in series, the switching element is formed of a first transistor connected to the first coil and a second transistor connected between the first transistor and the second coil, control terminals of the first and second transistors are connected by an auxiliary coil therebetween that produces an electromotive force by a magnetic flux in the transformer, the control terminal of either the first or second transistor is connected to the output terminal of the error amplifier, and a junction point between the first and second transistors is connected to a junction point between the first and second coils via the control terminal of the transistor and the output terminal of the error amplifier described above.

When a current flows to either one of the first coil and the second coil, an electromotive force is produced in the auxiliary coil so that conduction of either one of the first and second transistors currently in conduction is terminated and the other becomes conductive, and a current comes to flow to the other of the first coil and the second coil from an opposite direction. Thus, from the output-side coil magnetically coupled to the first and second coils, a voltage whose direction periodically changes, that is, an AC voltage, is outputted.

Moreover, it is preferable that switching of an over-light incidence discrimination signal by the discrimination unit is set within a range of incident light intensity where the anode output is saturated. This is because, if the incident light intensity is further increased, the anode current starts to fall, and data reliability is lost at that point in time. Also, since this switching is performed by activation of the transistor connected at a downstream of the junction point described above, it suffices to determine a resistance value to provide a rising threshold current of the transistor so as to meet the condition set in the above.

According to the present invention, even when the intensity of incident light into a photomultiplier tube is high, detection can be performed while determining reliability.

DESCRIPTION OF THE PREFERRED EMBODIMENTS

Hereinafter, a control circuit for a photomultiplier tube according to an embodiment will be described by citing an example of a photomultiplier tube module mounted with the same.

Figure 1:
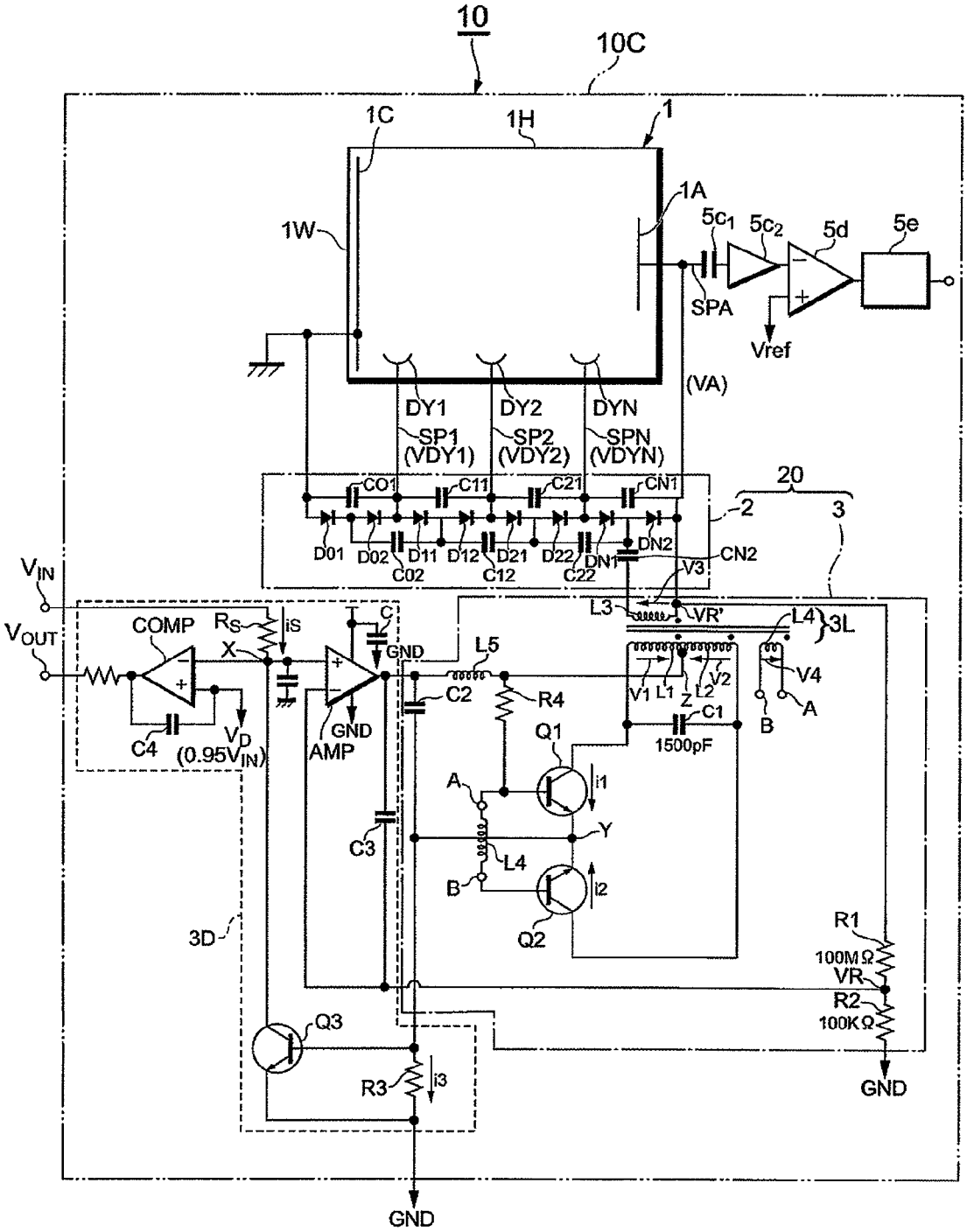
FIG. 1 is a circuit diagram of a photomultiplier tube module.

FIG. 1 is a circuit diagram of a photomultiplier tube module.

A photomultiplier tube module 10 includes a photomultiplier tube 1 arranged in a frame 10C and a control circuit thereof. The photomultiplier tube 1 includes a photocathode 1C provided inside a face plate 1W of a vacuum container 1H, a plurality of dynodes DY1, DY2, . . . , and DYN arranged in order in the vacuum container 1H, and an anode 1A. The anode 1A is connected with a stem pin SPA, and the stem pin SPA is connected to one input terminal of a comparator 5*d* via a coupling capacitor $\mathbf{5}c_1$ and a pulse amplifier $\mathbf{5}c_2$, in order, and an output of the comparator 5*d* is inputted to a signal processing circuit 5*e*. The other input terminal of the comparator 5*d* is inputted with a reference potential Vref.

When light is made incident into the photocathode 1C via a surface plate 1W of the photomultiplier tube 1, the photocathode 1C releases photoelectrons, and the released photoelectrons come flying toward the anode 1A while being amplified by the respective dynodes DY1, DY2, . . . , and DYN in order, and are lastly collected by the anode 1A. An anode current outputted from the anode 1A is outputted, if by a photon counting measuring method, in a form of a pulse per photon. An AC component of this pulse current passes through the coupling capacitor $\mathbf{5}c_1$, is amplified through the pulse amplifier $\mathbf{5}c_2$, and is shaped in a square wave by the comparator 5*d*. The reference potential Vref to be inputted to the comparator 5*d* is set to a noise level or more.

The signal processing circuit 5*e*, which is for counting pulses per unit time of a square wave outputted from the comparator 5*d*, converts the count to a digital value by counting for a fixed period of time by a counter, for example. This will cause a digital value according to the incident light intensity to be outputted from the photomultiplier tube module 10, however, the signal processing circuit 5*e* of a subsequent stage may not be incorporated in the module depending on the specification.

The photocathode 1C of the photomultiplier tube 1 is connected to a ground, the later stage of the dynodes DY1, DY2, . . . , and DYN has a higher potential, and potential of the anode 1A is set highest. The dynodes DY1, DY2, . . . , and DYN are connected to stem pins SP1, SP2, . . . , and SPN, respectively, and the potentials of the respective dynodes are provided as VDY1, VDY2, . . . , and VDYN, respectively, and the anode potential is provided as VA.

The control circuit for the photomultiplier tube 1 includes a high-voltage generating circuit 20 that generates a plurality of operating voltages VDY1, VDY2, . . . , and VDYN, and VA to be given to the photomultiplier tube 1, an anode terminal (stem pin SPA) that extracts an anode output of the photomultiplier tube 1, a discrimination unit 3D that generates an over-light incidence discrimination signal whose value is switched when a reference potential VR generated by the high-voltage generating circuit 20 has fallen under a threshold, and a monitor terminal $V_{OUT}$ that extracts the over-light incidence discrimination signal to the outside.

The operating voltages to be supplied to the photomultiplier tube 1 are set by a DC potential $V_{IN}$ inputted to a DC input terminal $V_{IN}$, and an over-light incidence discrimination signal $V_{OUT}$ is outputted from the monitor terminal $V_{OUT}$. Here, for the sake of convenience, the respective potentials are denoted with identical symbols to those of the terminals.

The discrimination unit that discriminates whether over-light has been made incident includes an error amplifier AMP to an inverting input terminal (first input terminal) of which the reference potential VR is inputted, a sensing resistor $R_S$ interposed between the DC input terminal $V_{IN}$ and a non-inverting input terminal (second input terminal) of the error amplifier AMP, and a comparator COMP having a pair of input terminals to which a junction point X between the non-inverting input terminal of the error amplifier AMP and the sensing resistor $R_S$ and a potential $V_D$ that gives the above-mentioned threshold are connected, respectively. This threshold is a value of the reference potential VR when the junction point X has a potential equal to the reference-side potential $V_D$ ($=0.95V_{IN}$) of the comparator COMP.

Moreover, the discrimination unit includes a transistor Q3 which is connected at a downstream of the junction point X and whose control input terminal (base) is connected to an output terminal of the error amplifier AMP.

In the present example, a 1V potential is given to the DC input terminal $V_{IN}$.

When the intensity of incident light into the photomultiplier tube 1 is increased and the anode current is increased, a current that is supplied to the high-voltage generating circuit 20 via the error amplifier AMP is also increased. Since this current flows through a resistor R3 connected between the base and emitter of the transistor Q3 as a current i3, a base-emitter voltage rises, and when this exceeds a threshold (=approximately 0.6V), the transistor Q3 is turned on, so that current flows to the transistor Q3.

Since the sensing resistor $R_S$ is connected at an upstream of the transistor Q3 via the junction point X, a current iS that flows through the sensing resistor $R_S$ is increased, and due to a decline in potential between both ends of the sensing resistor $R_S$, a potential difference between the DC input terminal $V_{IN}$ and the junction point X is increased. That is, a potential difference of the junction point X relative to the reference-side potential $V_D$ to be inputted to the comparator COMP is inverted, and a comparator output is switched to high level (ON). That is, due to lowering in the reference potential VR, an over-light incidence discrimination signal to be outputted from the comparator COMP is switched to ON.

Also, the reference-side potential $V_D$ of the comparator COMP is slightly lower ($V_D=0.95V_{IN}$) than the input potential $V_{IN}$, and for stabilization of the circuit, the output of the comparator COMP is not switched by a slight potential fluctuation of the junction point X.

The high-voltage generating circuit 20 has an AC generating circuit 3 that generates an AC voltage between both ends of a secondary coil L3 according to an input voltage $V_{IN}$ and a rectifier 2 that generates a plurality of operating voltages from the AC voltage outputted from the AC generating circuit 3.

The AC generating circuit 3 includes a primary coil L1 and L2 connected between the output terminal of the error amplifier AMP and a switching element Q1 and Q2 and a transformer 3L having the secondary coil L3 connected to an input side of the rectifier 2. The reference potential VR is a potential that is provided by resistive dividing between the secondary coil L3 and a ground. More specifically, between the secondary coil L3 and the ground, interposed are voltage-dividing resistors R1 (100 MΩ) and R2 (100 kΩ), and the reference potential VR is provided at a junction potential of these voltage-dividing resistors R1 and R2. The reference potential VR is fed back to the inverting input terminal of the error amplifier AMP. Also, a power supply side of the error amplifier AMP is connected with a capacitor C for stabilization. Moreover, other capacitors C1, C2, C3, and C4 are connected as illustrated, whereby circuit operations are stabilized and noise is removed.

When transistors Q1 and Q2 serving as the switching element become conductive intermittently, a current intermittently flows to the primary coil L1 and L2 from the output terminal of the error amplifier AMP, and at the secondary coil L3, generated is an AC voltage V3 induced by a magnetic flux generated in the primary coil L1 and L2, and by rectifying this voltage by the rectifier 2, various DC voltages to be given to the photomultiplier tube 1 are generated.

A potential VR' of the secondary coil L3 is indirectly represented by the reference potential VR provided by resistive dividing between the coil L3 and the ground. In this structure, by detecting the potential VR' of the transformer 3L side by the error amplifier AMP and transmitting the same to the primary coil L1 and L2, stabilization of an applied voltage to the photomultiplier tube 1 can be realized.

Moreover, the primary coil is formed by connecting a first coil L1 and a second coil L2 having an identical polarity in series, and the switching element is formed of a first transistor Q1 connected to the first coil L1 and a second transistor Q2 connected between the first transistor Q1 and the second coil L2.

Control terminals of the first transistor Q1 and the second transistor Q2 are connected by an auxiliary coil L4 therebetween that produces an electromotive force by a magnetic flux in the transformer 3L, the control terminal (base) of either the first transistor Q1 or the second transistor Q2 is connected to the output terminal of the error amplifier AMP, and a junction point Y between the first and second transistors Q1 and Q2 is connected to a junction point Z of the first coil L1 and the second coil L2 via the control terminal (base) of the transistor Q3, the interior of the error amplifier AMP, and the output terminal of the error amplifier AMP.

When a DC voltage is inputted from the terminal $V_{IN}$, a high level is outputted from the error amplifier AMP, and the current flows to a resistor R4 via a coil L5, the transistor Q1 is turned on, and a current i1 flows to the transistor Q1. A current flows from the first coil L1 to the transistor Q1, and a voltage V1 is generated at both ends of the first coil L1. A voltage V3 induced by a magnetic flux formed by the voltage V1 is generated in the secondary coil L3 having the same polarity. Then, by this magnetic flux, a voltage V4 is induced in the auxiliary coil L4, by the voltage V4 between both terminals A and B of the auxiliary coil L4, the first transistor Q1 is turned off, and a current i2 flows to the second transistor Q2 via the second coil L2 instead. A voltage V2 generated in the second coil L2 is reverse to the voltage V1, and the voltage V3 of the secondary coil L3 is reversed in direction. Then, the voltage V4 of the auxiliary coil L4 is also reversed in direction, and the first transistor Q1 is turned on instead of the second transistor Q2. Thereafter, by repeating this, an alternating current is generated.

More specifically, in this circuit, when a current flows to either one of the first coil L1 and the second coil L2, an electromotive force V4 is produced in the auxiliary coil L4 so that conduction of either one of the first and second transistors Q1 and Q2 currently in conduction is terminated and the other becomes conductive, and a current comes to flow to the other of the first coil L1 and the second coil L2 from an opposite direction. Thus, from the output-side coil L3 magnetically coupled to the first and second coils L1 and L2, a voltage whose direction periodically changes, that is, an AC voltage, is outputted.

When the reference voltage VR falls, potential of the inverting input terminal of the error amplifier AMP falls, and potential of the output terminal rises, so that the applied voltage to the photomultiplier tube 1 rises. When the reference potential VR rises, potential of the inverting input terminal of the error amplifier AMP rises, and potential of the output terminal falls, so that the applied voltage to the photomultiplier tube 1 falls. The error amplifier AMP thus functions as a stabilizing circuit.

When the current i3 that flows from the junction point Y to the resistor R3 greatly increases, the base-emitter voltage of the transistor Q3 increases, however, when this value exceeds a rising threshold of the transistor Q3, potential of the junction point X falls, and an output of the comparator COMP becomes high level, and simultaneously therewith, potential of the output terminal of the error amplifier AMP falls, and current to be supplied to the AC generating circuit 3 is reduced, so that the error amplifier AMP functions also as an over-current protection circuit.

The rectifier 2 is a voltage doubler rectifier having a voltage dividing function, and this is formed of diodes D01, D02, D11, D12, D21, D22, DN1, and DN2 connected in series in a forward direction from a side lower in potential, capacitors C01, C11, C21, and CN1 interposed between anodes of odd-numbered diodes and cathodes of even-numbered diodes adjacent to each other, capacitors C02, C12, and C22 interposed between anodes of even-numbered diodes and cathodes of odd-numbered diodes adjacent to each other, and a capacitor CN2 interposed between an anode of the last diode DN2 and the coil L3. The cathodes of even-numbered diodes become dynode voltages VDY1, VDY2, . . . , and VDYN, respectively, and a cathode of the diode DN2 is connected to the anode 1A.

As has been described above, in the control circuit according to the present embodiment, based on the reference potential VR generated in the high-voltage generating circuit 20, the comparator COMP outputs an over-light incidence discrimination signal $V_{OUT}$ to the outside of the module. It is revealed that, when an over-light incidence discrimination signal $V_{OUT}$ switched to high level from low level is outputted to the outside, data to be outputted from the anode terminal has no reliability while data has reliability before switching. Therefore, detection can be performed while determining reliability.

Figure 2:
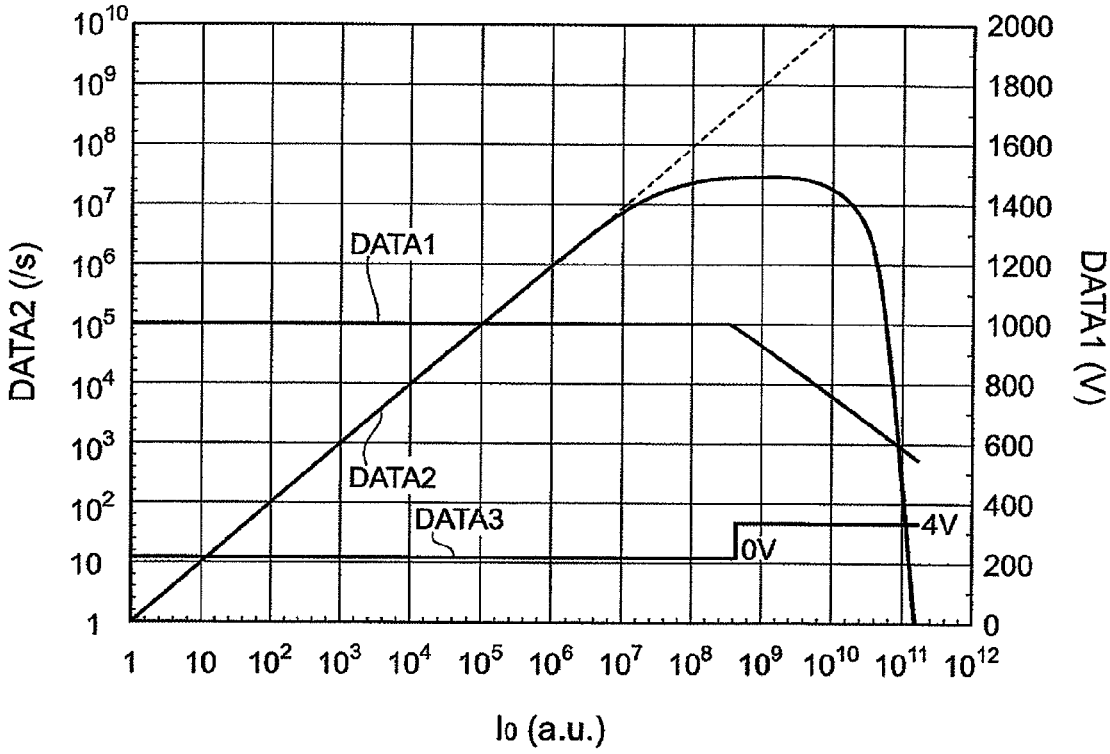
FIG. 2 is a log-log graph showing a relationship between the intensity (relative value) of incident light into a photomultiplier tube 1 and the number of pulses (output count (/s)) outputted from an anode.

FIG. 2 is a log-log graph showing a relationship between the intensity $I_0$ (a.u.) of incident light into the photomultiplier tube 1 and the number of pulses (output count DATA2 (/s)) outputted from the anode. In the same figure, also shown is a PMT applied voltage DATA1 (V) and an over-light detection output (DATA3). The PMT applied voltage is a voltage applied between the cathode and anode.

With an increase in the incident light intensity, the output count (DATA2) is linearly increased on the graph, however, when the incident light intensity exceeds a certain level ($\approx 10^7$ (relative value)), saturation starts for the reason described above, and the output count is saturated at approximately $5\times10^7$(/s). The applied voltage (PMT applied voltage: DATA1) to the photomultiplier tube 1 starts to fall when the incident light intensity exceeds $5\times10^8$ (relative value), and the over-light incidence discrimination signal $V_{OUT}$ serving as the over-light detection output (DATA3) is switched from low level to high level (4V in the present example). Switching of the over-light incidence discrimination signal $V_{OUT}$ by the discrimination unit is set within a range of the incident light intensity ($10^7$ to $10^{10}$ (relative value)) where the anode output is saturated (condition A). This is because a fall in potential of the high-voltage generating circuit (fall in the reference potential VR) due to an over-light incidence occurs after saturation of the anode output. Also, since this switching is performed by activation of the transistor Q3 connected at a downstream of the junction point X in FIG. 1, it suffices to determine a resistance value of the resistor R3 that provides the rising threshold current of the transistor Q3 so as to meet the condition A. In the present example, the resistance value of the resistor R3 is set to 40Ω.

Figures 3A, 3B, 3C, 3D, 3E:
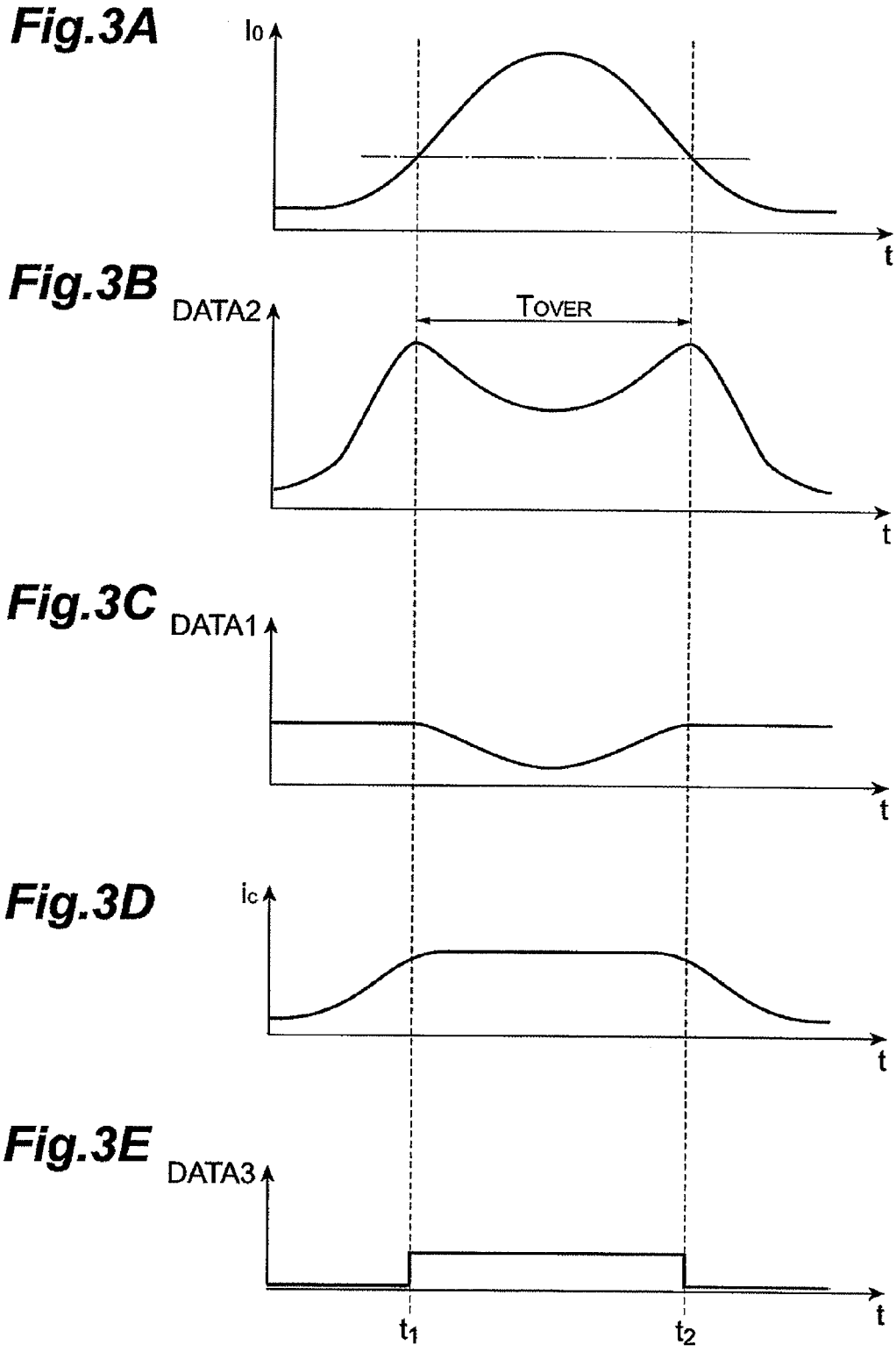
FIG. 3A is a timing chart of the incident light intensity.
FIG. 3B is a timing chart of the output count number.
FIG. 3C is a timing chart of a PMT applied voltage.
FIG. 3D is a timing chart of a consumption current of an AC generating circuit.
FIG. 3E is a timing chart of an over-light detection output.

FIG. 3A is a timing chart of the incident light intensity $I_0$, FIG. 3B is a timing chart of the output count number DATA2, FIG. 3C is a timing chart of a PMT applied voltage DATA1, FIG. 3D is a timing chart of a consumption current ic of an AC generating circuit, and FIG. 3E is a timing chart of an over-light detection output DATA3. Here, raised as an example is a case such that, as shown in FIG. 3A, the incident light intensity $I_0$ gradually increases, and through a peak equal to or more than such an intensity as to be determined to be over-light, the incident light intensity $I_0$ gradually falls.

As the input light intensity $I_0$ gradually increases, the output count number DATA2 increases, and the consumption current ic in the AC generating circuit 3 also continues to increase, however, when the incident light intensity $I_0$ has reached a certain level (time $t_1$), the output count number DATA2 starts to decline, the PMT applied voltage (reference potential VR) DATA1 starts to fall, and the consumption current ic in the AC generating circuit 3 also starts to be saturated. At this time, the over-light detection output DATA3 is switched to high level. Thereafter, when the incident light intensity $I_0$ starts to gradually fall after reaching a peak, the output count number DATA2 again starts to increase, the PMT applied voltage DATA1 starts to rise (rise in the reference potential VR), and the consumption current ic in the AC generating circuit starts to fall. Then, when the incident light intensity $I_0$ has reached a certain level (time $t_2$), the output count number again starts to fall, the PMT applied voltage DATA1 (reference potential VR) starts to be stabilized, and the consumption current ic in the AC generating circuit 3 starts to decline. At this time, the over-light detection output DATA3 is switched from high level to low level.

More specifically, in a continuous operation, by excluding therefrom a period where the over-light detection output is high level (over-light detection circuit operation) $T_{OVER}$, it becomes possible to measure reliable data. This has an advantage such that a measurement immediately after a PMT applied voltage recovery (from time $t_2$ onward), that is, from a point in time where reliable data came to be obtained is speedy and simple, in comparison with that, in a measuring method where the power is shut down in the execution of one measurement, a data measurement from the shutdown onward is impossible for at least a startup time of the device regardless of a change in the incident light intensity.

In the case of a conventional shutdown configuration without an auto voltage recovery function, an operation such as manually turning on the power again is necessary, so that a continuous measurement cannot be performed, however, in the present configuration, a continuous measurement is enabled. Moreover, in the case of a device with an auto recovery function where a high voltage is automatically turned on after a high-voltage power supply is once turned off and a certain length of time elapses, it is repeated to turn on and off a high voltage in a time of accumulation of output pulses by photon counting, and a pulse is outputted at the time when a high voltage is turned on, and thus, as a measurement result, a certain numerical value (number of pulses) is obtained, and whether this numerical value is a normal or abnormal value cannot be recognized based on only the result. However, in the present device, discrimination as to whether being a normal value or an abnormal value is also possible.

Moreover, the over-light detection output can also be used for the following applications.

By connecting the over-light detection output to an I/O port of a microcontroller (CPU) or the like used for reading out data from a counter circuit and monitoring the same, a determination as to whether obtained data is data at the time of over-light can be automatically performed in the microcontroller.

Furthermore, the over-light detection output can be connected to an LED drive circuit, so that, when over-light is inputted, an LED is lit to notify an abnormality.

Moreover, it is also possible to connect an over-light detection output to a shutter drive circuit and perform control so that, when over-light is made incident, a shutter disposed on the light incident surface of the photomultiplier tube 1 is closed to prevent the over-light from entering.

Moreover, it is also possible to connect an over-light detection output to an alarm drive circuit and perform control so that, when over-light is made incident, an alarm is issued to notify an abnormality.

Also, it is possible to apply the circuit described above to when divided voltages to be supplied to the respective dynodes are generated by a resistive dividing method and also when divided voltages are generated by use of an active bleeder.

What is claimed is:

1. A control circuit for a photomultiplier tube comprising:

a high-voltage generating circuit that generates a plurality of operating voltages to be given to a photomultiplier tube;

an anode terminal that extracts an anode output of the photomultiplier tube;

a discrimination unit that generates an over-light incidence discrimination signal whose value is switched when a reference potential generated by said high-voltage generating circuit falls under a threshold; and a monitor terminal that extracts the over-light incidence discrimination signal to an outside.

2. The control circuit for a photomultiplier tube according to claim 1, wherein said discrimination unit comprises:

an error amplifier for a first input terminal of which the reference potential is inputted;

a sensing resistor interposed between an DC input terminal and a second input terminal of said error amplifier;

a comparator having a pair of input terminals to which a junction point between said second input terminal of said error amplifier and said sensing resistor and a potential that gives the threshold are connected, respectively; and a transistor which is connected at a downstream of said junction point and whose control input terminal is connected to an output terminal of said error amplifier.

3. The control circuit for a photomultiplier tube according to claim 2, wherein said high-voltage generating circuit includes:

an AC generating circuit that generates an AC voltage according to an input voltage; and a rectifier that generates a plurality of the operating voltages from an AC voltage outputted from said AC generating circuit, and said AC generating circuit includes a primary coil connected between said output terminal of said error amplifier and a switching element and a transformer having a secondary coil connected to an input side of said rectifier, and the reference potential is a potential that is provided by resistive dividing between said secondary coil and a ground, and is fed back to said first input terminal of said error amplifier.

4. The control circuit for a photomultiplier tube according to claim 3, wherein said primary coil is formed by connecting first and second coils having an identical polarity in series, said switching element is formed of a first transistor connected to said first coil and a second transistor connected between said first transistor and said second coil, control terminals of said first and second transistors are connected by an auxiliary coil therebetween that produces an electromotive force by a magnetic flux in said transformer, said control terminal of either said first or second transistor is connected to said output terminal of said error amplifier, and a junction point between said first and second transistors is connected to a junction point between said first and second coils via said control terminal of said transistor and said output terminal of said error amplifier.

5. The control circuit for a photomultiplier tube according to claim 1, wherein switching of an over-light incidence discrimination signal by said discrimination unit is set within a range of incident light intensity where said anode output is saturated.

* * * * *